US008087461B2

(12) United States Patent
Fitzgerald

(10) Patent No.: US 8,087,461 B2
(45) Date of Patent: Jan. 3, 2012

(54) LOGGING WHILE PRODUCING APPARATUS AND METHOD

(75) Inventor: Peter Fitzgerald, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 96 days.

(21) Appl. No.: 12/236,649

(22) Filed: Sep. 24, 2008

(65) Prior Publication Data

US 2009/0084543 A1 Apr. 2, 2009

(30) Foreign Application Priority Data

Sep. 28, 2007 (EP) ..... 07117577

(51) Int. Cl.
*E21B 47/00* (2006.01)

(52) U.S. Cl. ..... 166/254.2; 166/66.4; 166/107; 166/250.15; 166/242.2

(58) Field of Classification Search ..... 166/250.15, 166/254.2, 107, 242.2, 66.4
See application file for complete search history.

(56) References Cited

U.S. PATENT DOCUMENTS

| | | | | |
|---|---|---|---|---|
| 3,917,230 | A * | 11/1975 | Barron | 254/270 |
| 4,098,342 | A * | 7/1978 | Robinson et al. | 166/385 |
| 4,157,657 | A * | 6/1979 | Hinchman | 73/53.01 |
| 4,358,088 | A * | 11/1982 | House et al. | 254/349 |
| 4,450,539 | A | 5/1984 | Bright | |
| 4,577,693 | A * | 3/1986 | Graser | 166/338 |
| 5,186,048 | A * | 2/1993 | Foster et al. | 73/152.02 |
| 6,263,730 | B1 * | 7/2001 | Grande et al. | 73/152.28 |
| 6,904,797 | B2 * | 6/2005 | Schrenkel et al. | 73/152.18 |
| 7,004,020 | B2 * | 2/2006 | Schrenkel et al. | 73/152.18 |
| 7,063,306 | B2 * | 6/2006 | Sanders et al. | 254/361 |
| 7,201,366 | B2 * | 4/2007 | Sanders et al. | 254/361 |
| 7,640,979 | B2 * | 1/2010 | Watson et al. | 166/254.2 |
| 2005/0072965 | A1 * | 4/2005 | Sanders et al. | 254/361 |
| 2005/0199394 | A1 * | 9/2005 | Schrenkel et al. | 166/254.2 |
| 2005/0263289 | A1 | 12/2005 | Kanady | |
| 2006/0192188 | A1 * | 8/2006 | Sanders et al. | 254/361 |
| 2007/0052551 | A1 * | 3/2007 | Lovell et al. | 340/854.6 |
| 2007/0126595 | A1 * | 6/2007 | Murphy | 340/853.7 |
| 2007/0295502 | A1 * | 12/2007 | Watson et al. | 166/254.2 |
| 2008/0196880 | A1 * | 8/2008 | Head | 166/66.4 |
| 2009/0084543 | A1 * | 4/2009 | Fitzgerald | 166/250.01 |
| 2009/0166035 | A1 * | 7/2009 | Almaguer | 166/254.1 |

FOREIGN PATENT DOCUMENTS

| | | |
|---|---|---|
| EP | 0417369 | 3/1991 |

* cited by examiner

*Primary Examiner* — Jennifer H Gay
(74) *Attorney, Agent, or Firm* — Jianguang Du

(57) ABSTRACT

Production logging apparatus and method are provided. The apparatus comprises a coupling module, an electronic module, a micro-winch, a docking station, and a micro-production logging tool. The coupling module provides mechanical support for the production logging apparatus below a pumping arrangement disposed in a wellbore, and allows flow to enter the pumping arrangement. The electronic module comprises a winch controller, a powering module and a telemetry module, and adapted to automate the micro-winch. The docking station comprises a latching mechanism for ensuring positive engagement of a micro-production logging tool with the production logging apparatus during docking. And the micro-production logging tool comprises at least one sensor and is coupled to the micro-winch by a cable for regular production logging runs to measure the evolution of well characteristics.

11 Claims, 4 Drawing Sheets

FIG. 1 - PRIOR ART

LOGGING WHILE PRODUCING APPARATUS AND METHOD

FIELD OF THE INVENTION

The invention relates to an apparatus and a method of production logging. The invention finds a particular application in the oilfield industry.

BACKGROUND OF THE INVENTION

"Production Logging" is a common, long-established technique for determining the contribution of various producing depth intervals in a hydrocarbon well to the total flow and fluid composition that is observed at surface. Many different sensor types and tool configurations exist to make the measurements that such techniques require.

In a naturally-producing well, where the reservoir pressure is sufficient to cause fluids to flow from the formation into the wellbore, it is relatively simple to lower a logging tool comprising such production logging sensors on wireline or on slickline.

In a well where the reservoir pressure is not sufficient to cause fluids to flow from the formation GF into the wellbore WB, a pumping arrangement PA (often abbreviated as ESP: Electrical Submersible Pump) is required to raise fluids to the surface ST as schematically depicted in FIG. 1. Fluid enters the wellbore below the pumping arrangement. Above the pump, the fluid flows usually in production tubing PT that channels the pumping arrangement output to surface. Clearly, in either case it is necessary to perform the production logging data acquisition below the pumping arrangement, as this is where the fluid is entering the wellbore. However, such a pumping arrangement PA represents a mechanical obstacle to lower a logging tool TL into the wellbore WB.

A first known technique enabling logging below the pumping arrangement is to install a branch in the tubing known as a "Y-tool" YT. The pumping arrangement PA is comprised in one of the branches of the Y-tool YT. By removing a plug in the other branch of the Y-tool YT, the logging tool can be lowered below the pumping arrangement PA. However, this technique requires removing the plug before logging, and replacing it afterwards. Further, with this technique it is necessary to seal around the cable LN while running the production logging acquisition. Furthermore, the pumping arrangement needs to be mechanically bypassed, which restricts the size of both the pumping arrangement and the logging tool.

A second known technique enabling logging below the pumping arrangement is described in document U.S. Pat. No. 6,120,261. This document describes a combined electric motor and submersible pump apparatus intended for installation in line with the well tubing. The apparatus comprises a hollow drive shaft having a downstream end secured to the rotor of the motor and mounted for rotation in axial alignment with the axis of the tubing. The pump impellers are mounted on the upstream end of the hollow shaft. The shaft also has inlet and discharge ports and a check valve mounted on the interior of the drive shaft that is closed when the pump is activated. When the check valve is in the open position, a wire line tool can be passed through the hollow drive shaft to a position below the apparatus. However, this technique requires considerably modifying the structure of the pumping arrangement. Further, it is more expensive than standard pumping arrangements.

SUMMARY OF THE INVENTION

It is an object of the invention to propose an apparatus and a method to log while producing a hydrocarbon well that overcomes at least one of the drawbacks of the prior art apparatuses and methods.

According to an aspect, the invention relates to a production logging apparatus comprising:

- a coupling module providing a mechanical support for the production logging apparatus below a pumping arrangement disposed in a wellbore, and allowing flow to enter the pumping arrangement,
- an electronic module comprising a winch controller, a powering module and a telemetry module,
- a micro-winch,
- a docking station comprising a latching mechanism for ensuring positive engagement of a micro-production logging tool, and
- a micro-production logging tool comprising at least one sensor and coupled to the micro-winch by a cable.

The micro-winch may be a motor-gear-drum arrangement.

The micro-winch may have automated spooling capability, and comprises depth-measurement and tension-measurement devices.

The docking station may also comprise an inductive coupling link to transfer power and command to the micro-production logging tool, and retrieve measurement data from the micro-production logging tool when the micro-production logging tool is latched in the docking station.

The micro-production logging tool may further comprise a battery and a memory, and may be further coupled to the micro-winch through a slickline.

Alternatively, the micro-production logging tool may be coupled to the micro-winch through an electrically-conductive wireline. Advantageously, the wireline permits delivery of electrical power to the tool from the docking station and real-time communication between the tool and the docking station.

Advantageously, the production logging apparatus may be coupled to a surface unit through a cable coupling the pumping arrangement to a surface equipment.

According to a further aspect, the invention relates to a production logging method comprising the steps of:

- coupling a production logging apparatus comprising a coupling module, an electronic module, a micro-winch, a docking station and a micro-production logging tool according to the invention below a pumping arrangement, the micro-production logging tool being latched into the docking station,
- positioning the pumping arrangement together with the production logging apparatus in a wellbore, and
- commanding the micro-winch in order to deploy the micro-production logging tool in the wellbore below the pumping arrangement, and log a depth interval.

The production logging method may further comprise transmitting in real-time measurement data from the micro-production logging tool to the electronic module.

Alternatively, the production logging method may further comprise:

- storing measurement data in the micro-production logging tool and transmitting said data to the electronic module,
- returning the micro-production logging tool in the docking station, and
- retrieving said data from the micro-production logging tool into the electronic module.

The production logging method may further comprise driving and powering the production logging apparatus through a cable coupling the pumping arrangement to a surface equipment.

Thus, the invention enables logging below a pumping arrangement in a producing well while not using any special Y-tool. The invention has numerous advantages, including the ability to perform multiple production logging acquisitions at regular time intervals without the need for repeated wireline runs, in cases where the apparatus of the invention is installed downhole for a long period of time.

The simplified micro winch design and the production logging tool miniaturization enable running any production logging sensors below the pumping arrangement regardless of the wellbore diameter.

The production logging apparatus of the invention can be designed in near real-time configuration or in real time configuration. In the near real-time configuration, the measurement data can be retrieved from the tool memory as soon as the log is completed and the micro production logging tool is returned in its docking station. In the real-time configuration, the measurement data can be transmitted to the surface during the logging operation. Both configurations enable interpretation of the logging data without the need to return the logging tool back to surface, and thus without any time loss.

These and other aspects of the invention will be apparent from and elucidated with reference to the embodiments described hereinafter.

BRIEF DESCRIPTION OF THE DRAWINGS

The present invention is illustrated by way of example and not limited to the accompanying figures, in which like references indicate similar elements.

DETAILED DESCRIPTION OF THE INVENTION

Figure 1:
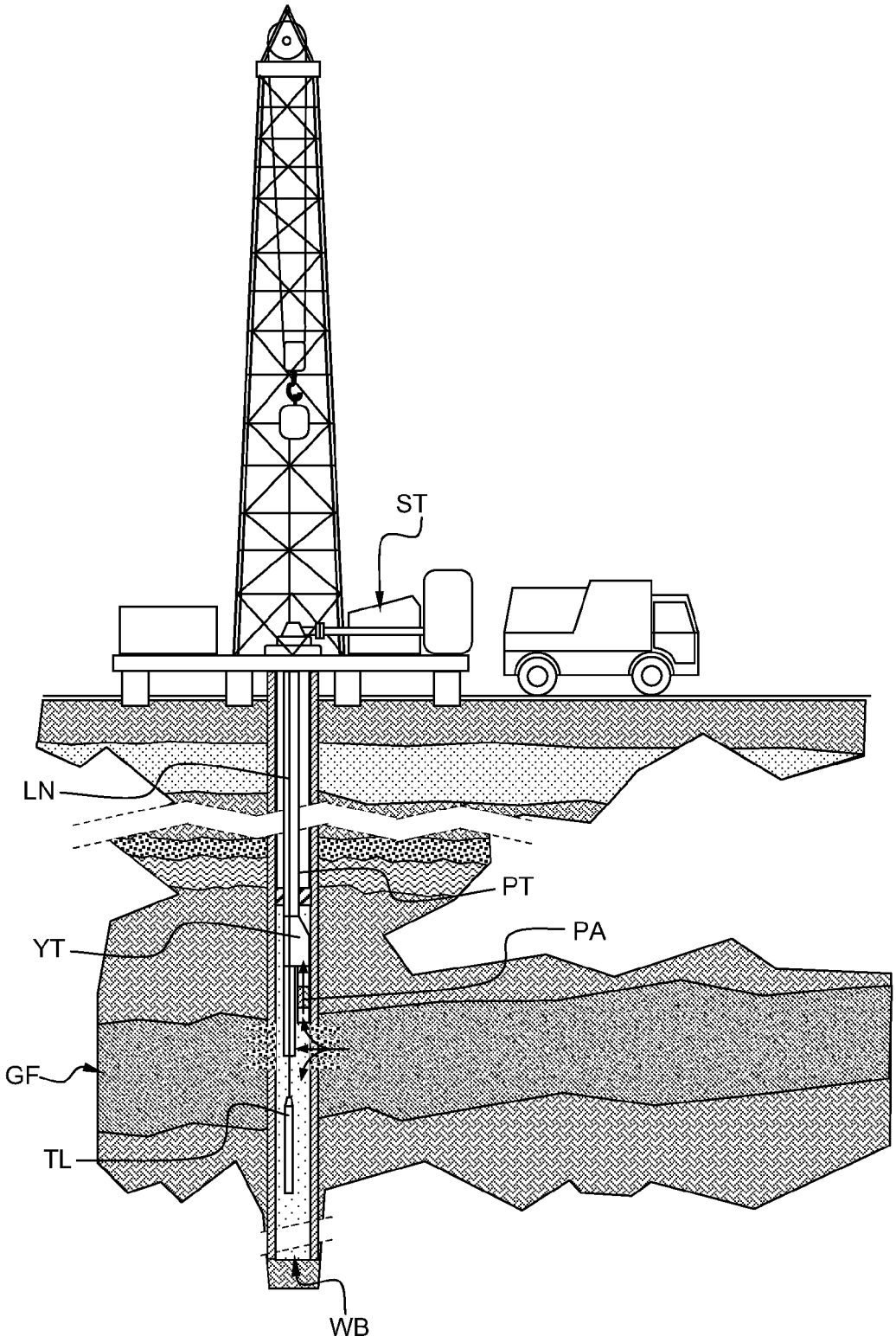
FIG. 1 schematically shows a typical onshore hydrocarbon well location and a pumping arrangement and logging tool according to the prior art.
Figure 2:
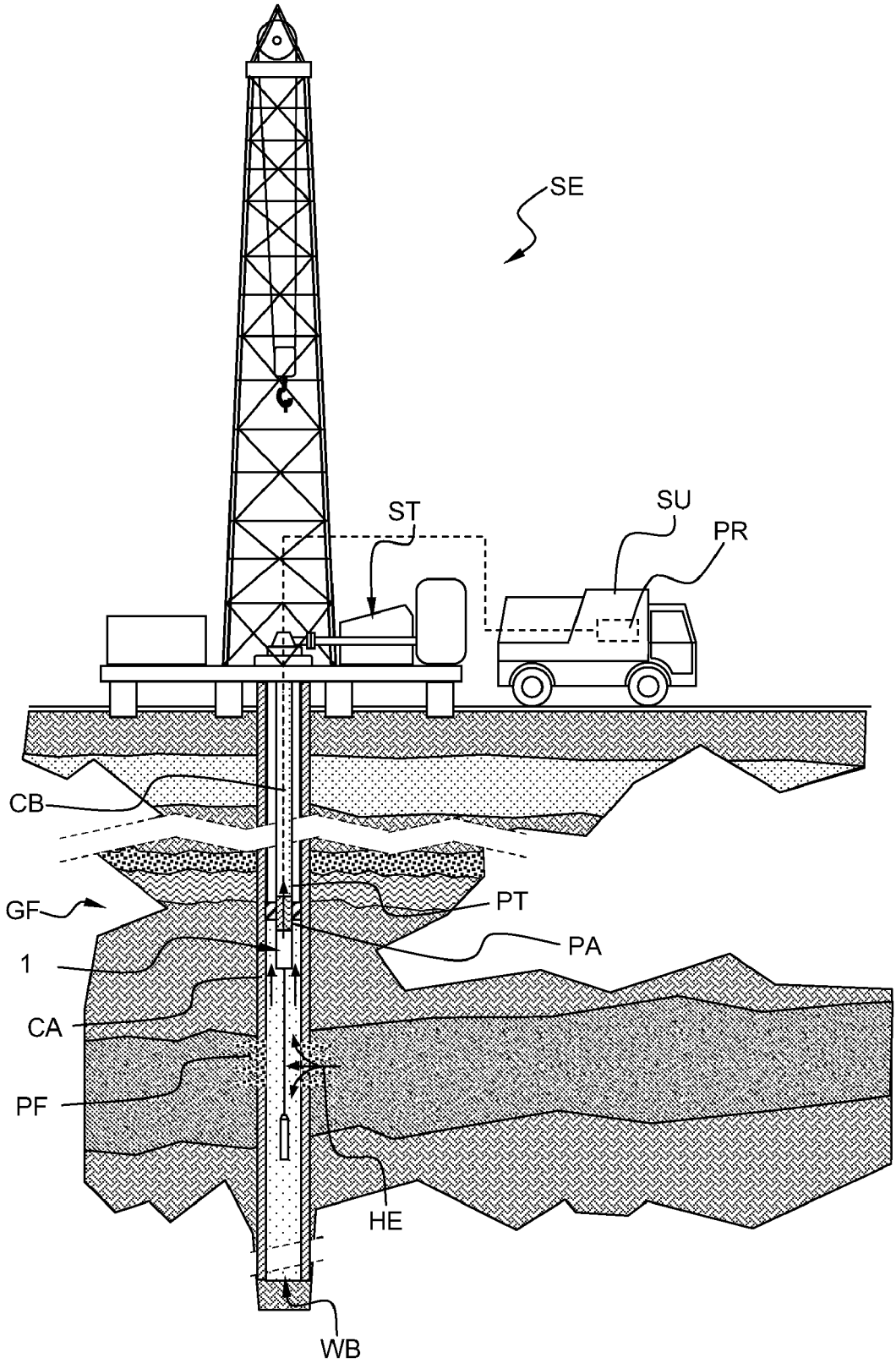
FIG. 2 schematically shows a typical onshore hydrocarbon well location and a pumping arrangement and production logging apparatus according to the invention.

FIG. 2 schematically shows a typical onshore hydrocarbon well location and surface equipments SE above hydrocarbon geological formations GF after wellbore WB drilling operations have been carried out, a casing string has been run and cementing operations have been carried out. The casing CA has been perforated PF in order to put in communication a selected portion of the formation containing hydrocarbon and the wellbore. Further, a production tubing PT and a pumping arrangement PA have been inserted into the well bore WB. The pumping arrangement PA raises the hydrocarbon effluent HE to the surface. The hydrocarbon effluent HE enters the wellbore WB through the perforations PF below the pumping arrangement and flows in the production tubing PT towards surface treatment equipment ST. Though not shown in the drawings, when no production tubing is present, the fluid may flow simply in the casing in which the pumping arrangement is installed.

A production logging apparatus 1 to log while producing the hydrocarbon well according to the invention is coupled to the pumping arrangement PA and preferably disposed under the pumping arrangement PA.

In this example, the surface equipments SE comprise an oil rig, surface treatment equipment ST and a surface unit SU. The surface unit may be a vehicle coupled to the production logging apparatus by a cable CB. The measurement data, which may be collected by the production logging apparatus 1, may be transmitted to the surface unit SU by any known technique, or otherwise stored in the production logging apparatus memory for subsequent processing when the memory is returned to the surface. The surface unit SU comprises appropriate electronic and software arrangements PR for processing, analyzing and storing the measurement data provided by the production logging apparatus 1.

The delivery of electrical power from the surface, and communication between the downhole equipment and the surface unit, may be accomplished using the electrical cables already in place to supply power to the pumping arrangement. Such communication is already in common use in oilfield applications for performing, and transmitting back to surface, measurements that may be used to characterize the pumping arrangement performance. In such an implementation, the need for a separate surface unit SU is limited to the provision of a relatively simple computer and set of electronics for processing these telemetry signals, as no extra cable need be deployed. In addition, such an implementation will eliminate, or at least reduce, the need for much surface hardware (stuffing-box, pressure-control equipment, complex wellhead, etc. . . . ) that is usually required for production logging.

Figure 3:
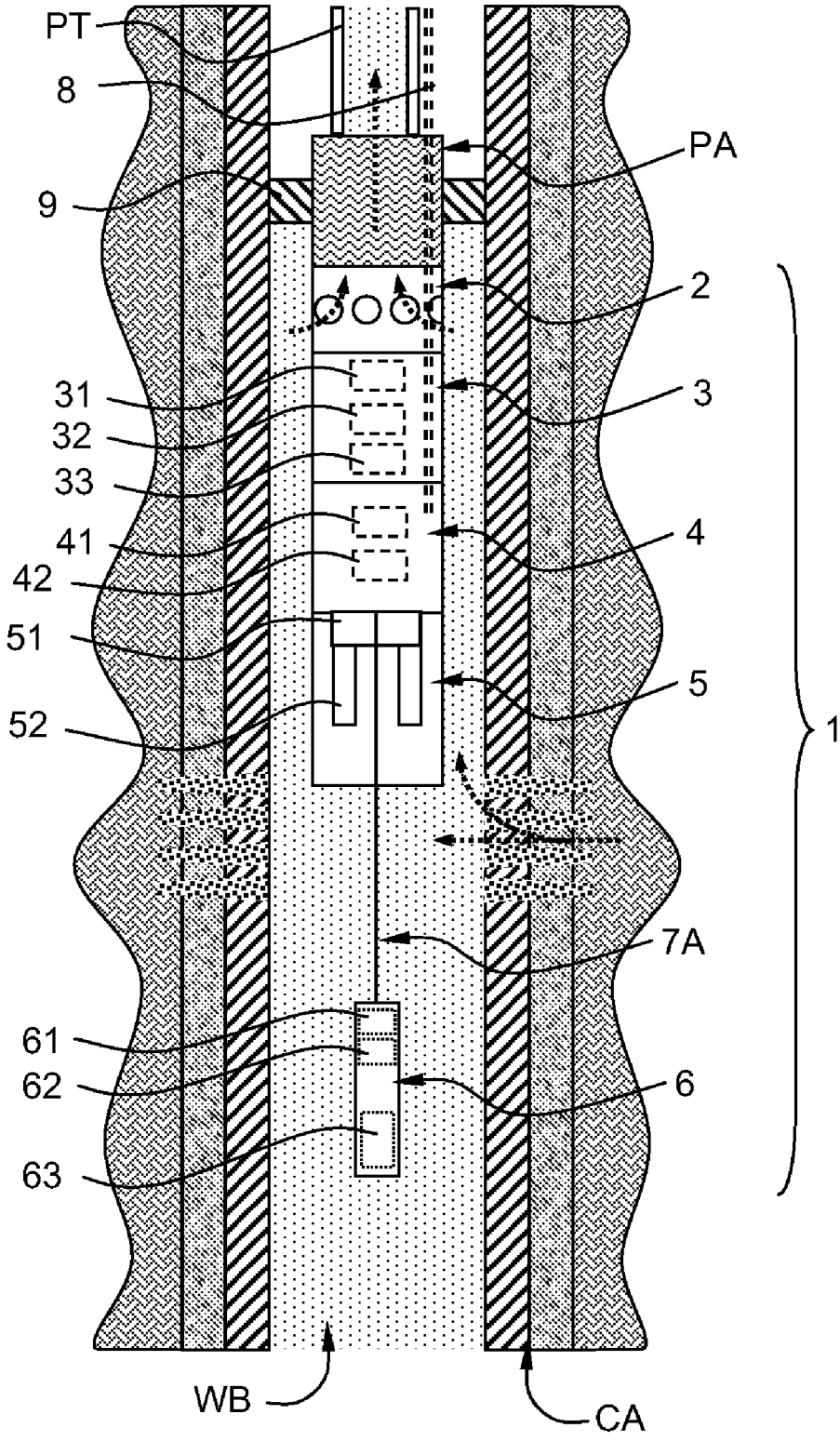
FIGS. 3 and 4 are detailed views schematically showing the pumping arrangement and the production logging apparatus of the invention according to a first and a second embodiment, respectively.
Figure 4:
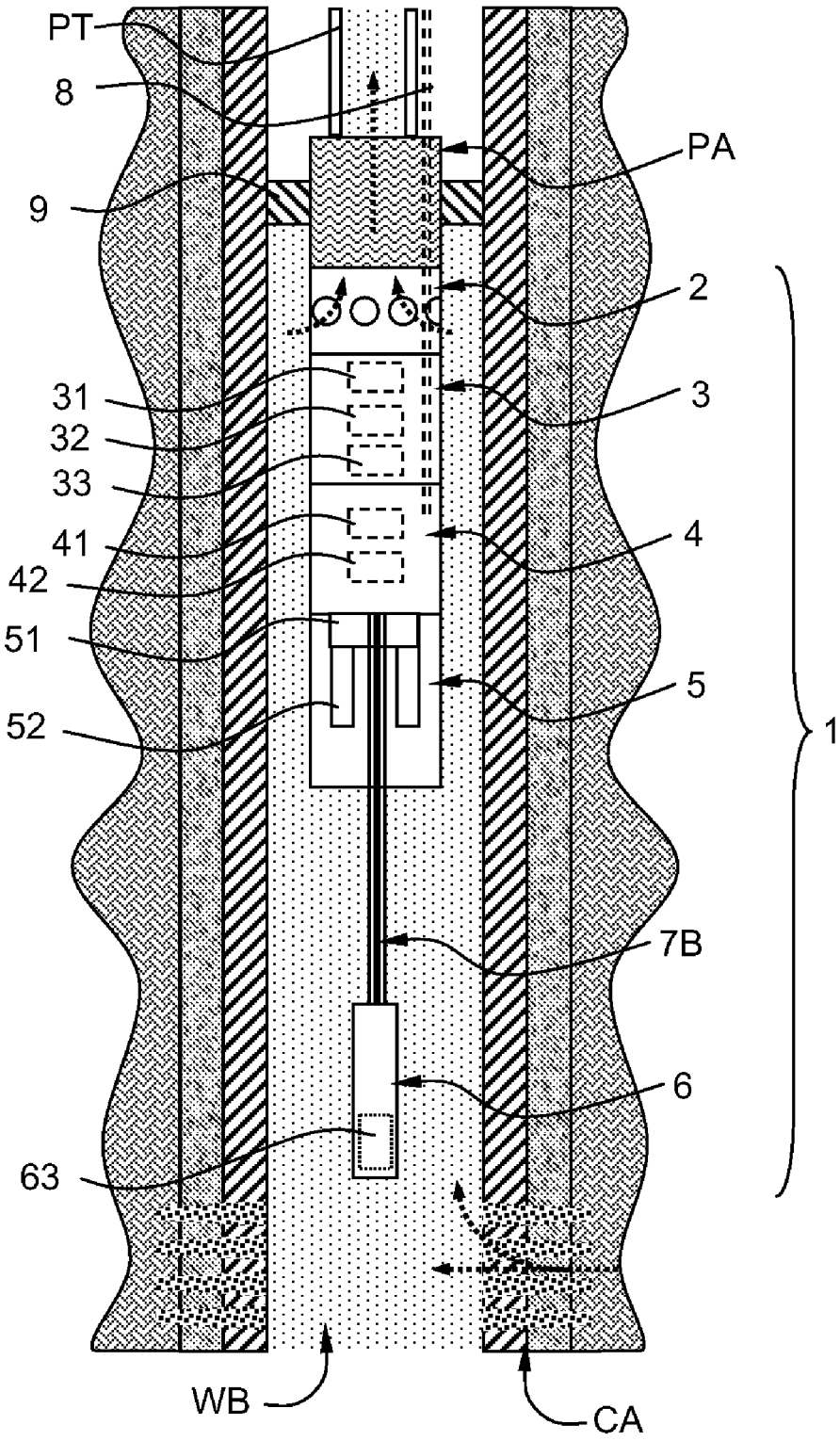

FIGS. 3 and 4 are detailed views schematically showing the pumping arrangement PA and the production logging apparatus 1 of the invention according to a first and a second embodiment, respectively.

The pumping arrangement PA is fitted into the wellbore WB and secured to the casing CA by, for example, a plug 9. The output of the pumping arrangement is coupled to a production tubing PT. The pumping arrangement PA is a standard electrical submersible pump. Advantageously, it is modified to allow power and telemetry connections 8 to the production logging apparatus 1 attached below.

The production logging apparatus 1 comprises a coupling module 2, an electronic module 3, a micro-winch 4, a docking station 5, a cable 7A, 7B, and a micro-production logging tool 6.

The coupling module 2 couples the production logging apparatus 1 to the pumping arrangement PA. It provides a mechanical support for the production logging apparatus 1 below the pumping arrangement while allowing flow to enter the pumping arrangement. The coupling module 2 comprises flow entry ports and a flow output port. The flow entry ports may be disposed on the circumference of the coupling module 2. The flow output port corresponds to the flow entry port of the pumping arrangement. These features enable maximizing the flow penetrating into the pumping arrangement. The coupling module 2 also allows for electrical and possibly optical connections from the pumping arrangement to the electronic module 3 and the micro-winch 4. Typically, the production logging apparatus 1 is coupled to the pumping arrangement through the coupling module and the pumping arrangement PA and the production logging apparatus 1 are positioned in the wellbore WB at a desired depth.

The electronic module 3 is a package of electronics comprising a winch controller 31, a powering module 32 to power the micro-production logging tool 6, and a telemetry module 33. The electronic module may also comprise usual powering means for the whole production logging apparatus 1. The winch controller 31 commands the operation of the micro-winch 4. The powering module 32 may comprise, for example, an inductive-coupling connection in order to power the micro-production logging tool 6 when locked in the docking station 5. The telemetry module 33 provides telemetry to and from the surface equipment, for example via the cable CB. Alternatively, other way of exchanging commands or data between the telemetry module and the surface equipment may be used, e.g. mud pulse technique. Advantageously, the cable CB also provides power to the electronic module 3 and the micro-winch 4.

The micro-winch 4 may be a small motor-gear-drum arrangement. It enables to deploy the micro-production logging tool 6 at a desired depth below the pumping arrangement. Advantageously, the micro-winch 4 has automated spooling capability, and depth-measurement 41 and tension-measurement 42 devices. The depth-measurement device determines the depth position of the micro-production logging tool 6 relative to the surface level. Advantageously, the micro-winch is compact and has a limited capacity, as the length intervals to be logged below the pumping arrangement PA are usually small compared to the total well depth (i.e. relative to the surface). The micro-winch 4 is powered electrically, and controlled via the electronic module 3 from the surface.

The docking station 5 provides a protective sleeve 52 around the micro-production logging tool 6 when the production logging apparatus 1 is run in the wellbore hole or pulled out of the wellbore, or when the micro-production logging tool 6 is inactive downhole. Advantageously, the docking station 5 comprises a latching mechanism to ensure positive engagement of the micro-production logging tool 6 at all times other than when an acquisition pass is underway. This enables preventing excessive stress on the cable or tool head. The docking station 5 may also comprise an inductive coupling link 51. This may enable transferring power to the micro-production logging tool 6, programming the next acquisition sequence, and retrieval of data stored within the micro-production logging tool 6 from a previous acquisition session when the micro-production logging tool is run in a memory mode that will be described in details hereinafter.

The micro-production logging tool 6 comprises at least one sensor 63. The sensor may be of various types and may provide various measurement data related to the hydrocarbon geological formation and/or the hydrocarbon effluent contained within the geological formation or flowing into the wellbore. For example, the sensor may be capable of pressure, temperature, flow, "holdup" (i.e. fraction of water, oil and gas present in the wellbore at a given depth), conductivity, resistivity, etc. . . . measurements. Once the micro-production logging tool 6 is positioned at a desired depth due to the operation of the micro-winch under the command of the winch controller 31, characteristic parameters of a selected zone of the formation, or of the fluid in the vicinity of the micro-production logging tool 6 can be measured. Such measurements can be repeated for other azimuths and other depths. As the winch and micro-production logging tool are at the same pressure downhole, there is no need for pressure-control equipment between them, and thus no need for any great weight to allow the tool to descend in the wellbore. Further, the length of logging cable required to log the interval under investigation is typically very much shorter than the well depth, and thus the length and weight of the logging cable is greatly reduced as compared to typical production logging jobs run from surface. As a consequence, the total weight to be supported by the cable and the micro-winch is small compared to that when running a traditional production logging tool. The production logging tool enables running, in an automated fashion, production logs on a regular and routine basis when the tool is installed for a long period. For example, production logging runs may be made every day in order to monitor the evolution of the well characteristics. This potentially opens new markets for well evaluation.

FIG. 3 schematically depicts the production logging apparatus 1 of the invention according to a first embodiment. In the first embodiment, the micro-production logging tool 6 works in a memory mode, namely the acquired data is stored within the micro-production logging tool. The micro-production logging tool 6 according to the first embodiment comprises a battery 61, a memory 62, at least one sensor 63 and is coupled to the micro-winch 5 through a slickline 7A. The slickline 7A is a non electric cable usually containing no component permitting real-time telemetry to or from the micro-production logging tool 6. When, the micro-production logging tool works according to the memory mode, measurement data is acquired and stored within the memory 62. When the micro-production logging tool 6 is housed in the docking station 5, for example after the acquisition pass is completed, the inductive coupling link 51 enables charging of the battery 61, programming of the next desired acquisition sequence, and retrieval of the data stored in the memory 62.

FIG. 4 schematically depicts the production logging apparatus 1 of the invention according to a second embodiment. In the second embodiment, the micro-production logging tool 6 works in "real-time mode", namely the measurement data is transmitted in real time to the electronic module 3. The micro-production logging tool 6 according to the second embodiment comprises only at least one sensor 63 and is coupled to the micro-winch 5 through a wireline 7B. The wireline 7B is usually an electrical or optical cable enabling power and/or telemetry connection between the micro-production logging tool 6 and the electronic module 3 via the micro-winch 5. The wireline 7B offers the ability to send significant power to the micro-production logging tool 6, as well as control its operation and retrieve its measurement data in real time. Further, the battery and/or the memory become unnecessary.

As an alternative embodiment not shown, the production logging tool 1 may further comprise a tractoring device permitting entry into highly-deviated portions of the wellbore below the pumping arrangement.

FINAL REMARKS

Though the invention has been described in relation with a particular application of the analyzing device to an onshore hydrocarbon well location, the invention may also apply to offshore hydrocarbon well locations. Further, the invention is not limited to oilfield application, as those versed in the art will recognize that the invention may apply in other applications where measurements need to be performed under downhole pumping arrangement, for example in a water well.

The drawings and their description hereinbefore illustrate rather than limit the invention.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A production logging apparatus comprising:

a coupling module providing a mechanical support for the production logging apparatus below a pumping arrangement (PA) disposed in a wellbore (WB), and allowing flow to enter the pumping arrangement (PA), the coupling module is separate from the pumping arrangement (PA) and couples the production logging apparatus to the pumping arrangement (PA), an electronic module comprising a winch controller, a powering module and a telemetry module, a micro-winch automated by the electronic module, a docking station comprising a latching mechanism for ensuring positive engagement of a micro-production logging tool with the production logging apparatus during docking, and the micro-production logging tool comprising at least one sensor and coupled to the micro-winch by a cable for regular production logging runs to measure the evolution of well characteristics, wherein the docking station is positioned entirely below the micro-winch when the production logging apparatus is disposed in the wellbore (WB).

2. The production logging apparatus according to claim 1, wherein the micro-winch is a motor-gear-drum arrangement.

3. The production logging apparatus according to claim 2, wherein the micro-winch comprises depth-measurement and tension-measurement devices.

4. The production logging apparatus according to claim 1, wherein the docking station also comprises an inductive coupling link to transfer power and commands to the micro-production logging tool, and retrieve measurement data from the micro-production logging tool when the micro-production logging tool is latched in the docking station.

5. The production logging apparatus according to claim 1, wherein the micro-production logging tool further comprises a battery and a memory, and is coupled to the micro-winch through a slickline.

6. The production logging apparatus according to claim 1, wherein the micro-production logging tool is coupled to the micro-winch through a wireline.

7. The production logging apparatus according to claim 1, wherein the production logging apparatus is coupled to a surface unit (SU) through a cable (CB) coupling the pumping arrangement (PA) to a surface equipment (SE).

8. A production logging method comprising:

coupling a production logging apparatus to and below a pumping arrangement (PA) via a coupling module, the production logging apparatus comprising the coupling module, an electronic module, a micro-winch, a docking station and a micro-production logging tool according to claim 1, wherein the docking station is positioned entirely below the micro-winch when the production logging apparatus is disposed in the wellbore (WB), the micro-production logging tool being latched into the docking station, positioning the pumping arrangement (PA) together with the production logging apparatus in a wellbore (WB), and commanding the micro-winch in order to automatically deploy the micro-production logging tool in the wellbore (WB) below the pumping arrangement (PA), and log a depth interval.

9. The production logging method according to claim 8, wherein the method further comprises transmitting in real-time measurement data from the micro-production logging tool to the electronic module.

10. The production logging method according to claim 8, wherein the method further comprises the steps of:

storing measurement data in the micro-production logging tool and transmitting said data to the electronic module, returning the micro-production logging tool in the docking station, and retrieving said data from the micro-production logging tool into the electronic module.

11. The production logging method according to claim 8, wherein the method further comprises driving and powering the production logging apparatus through a cable (CB) coupling the pumping arrangement (PA) to a surface equipment (SE).

* * * * *